US007188058B2

(12) United States Patent
Hardy et al.

(10) Patent No.: US 7,188,058 B2
(45) **Date of Patent: *Mar. 6, 2007**

(54) METHOD OF LOAD AND FAILURE PREDICTION OF DOWNHOLE LINERS AND WELLBORES

(75) Inventors: Humphrey H. Hardy, Ponca City, OK (US); Mamdouh M. Salama, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 900 days.

This patent is subject to a terminal disclaimer.

(21) Appl. No.: 10/036,813

(22) Filed: Dec. 21, 2001

(65) Prior Publication Data

US 2002/0059048 A1 May 16, 2002

Related U.S. Application Data

(63) Continuation-in-part of application No. 09/949,966, filed on Sep. 10, 2001, and a continuation-in-part of application No. 09/542,307, filed on Apr. 4, 2000, now Pat. No. 6,370,491.

(51) Int. Cl.
*G06G 7/48* (2006.01)

(52) U.S. Cl. ..... 703/10; 703/2; 703/6; 703/7; 703/9; 702/6; 702/11; 702/27

(58) Field of Classification Search ..... 703/2, 703/7, 10, 6, 9, 11; 702/6, 11, 27; 73/152; 507/277

See application file for complete search history.

(56) References Cited

U.S. PATENT DOCUMENTS 3,688,851 A 9/1972 Chenevert ..... 175/50
4,972,703 A 11/1990 Ho ..... 73/151
5,044,198 A * 9/1991 Ho ..... 73/152.49
5,829,522 A 11/1998 Ross et al. ..... 166/228
6,038,514 A * 3/2000 Nozaki ..... 702/27
6,044,328 A * 3/2000 Murphy et al. ..... 702/11
6,053,250 A 4/2000 Echols ..... 166/317
6,069,118 A * 5/2000 Hinkel et al. ..... 507/277
6,070,125 A * 5/2000 Murphy et al. ..... 702/11
6,078,867 A * 6/2000 Plumb et al. ..... 702/6

(Continued)

OTHER PUBLICATIONS

"Predictive modeling of naturally fractured reservoirs using geomechanics and flow simulation", Bourne et al, International Petroleum Exhibition and Conference, SPE 87253, Copyright 2000 SPE.*

"The COMPANY: GeoCap", GeoCap Product Description, May 1998.*

"dGB++", Newsletter of dGB, Feb. 2001.*

"Hydraulic Fracture Simulation with the Distinct Element Method", de Pater, Geophysics and Petrophysics, Dept. of Applied Earth Sciences, 1999.*

*Primary Examiner*—Fred Ferris
(74) *Attorney, Agent, or Firm*—Madan, Mossman & Sriram & P.C.

(57) ABSTRACT

A dynamic range relaxation algorithm is applied to simulate borehole failure under a variety of stress conditions. The borehole and its neighborhood are modeled by a number of regions by a plurality of interconnected nodes. The bonds between the nodes may be modeled as springs, rods, or beams. The strength of the bonds has a statistical variation to accurately simulate real world situations. The model may include, in addition to the borehole and the far earth formations, a liner, a casing, and/or a gravel pack. Simulation is carried out for different strength of the bonds.

32 Claims, 5 Drawing Sheets
(3 of 5 Drawing Sheet(s) Filed in Color)

U.S. PATENT DOCUMENTS 6,089,744 A * 7/2000 Chen et al. ..... 703/2
6,283,214 B1 9/2001 Guinot et al. ..... 166/297
6,370,491 B1 * 4/2002 Malthe-Sorenssen et al. .. 703/2
6,687,660 B2 * 2/2004 Robinson et al. ..... 703/10
6,785,641 B1 * 8/2004 Huang ..... 703/7

* cited by examiner

METHOD OF LOAD AND FAILURE PREDICTION OF DOWNHOLE LINERS AND WELLBORES

REFERENCES TO RELATED APPLICATIONS

This application is a continuation-in-part of U.S. patent application Ser. No. 09/949,966 filed on Sep. 10, 2001 that is a continuation-in-part of U.S. patent application Ser. No. 09/542,307 Apr. 4, 2000, now U.S. Pat. No. 6,370,491, both of which are incorporated herein by reference.

BACKGROUND OF THE INVENTION

1. Field of the Invention

The invention relates to a method for modeling stresses in the vicinity of a borehole and predicting the failure of liners or screens.

2. Background of the Invention

Sand control screens are utilized for various purposes in subterranean wells. The name derives from their early use in preventing the production of sand along with fluids from formations. A sand control screen is typically suspended from production tubing extending to the earth's surface and positioned in a wellbore opposite a productive formation. The wellbore in an annular area between the screen and the casing may be filled with a relatively large grain sand ("gravel"). This gravel prevents the fine sand from packing around the production tubing and screen and the screen prevents the large grain sand, gravel, from entering the production tubing. In this way, the sand control screen may exclude the produced sand while permitting the valuable fluids to enter the tubing for transport to the earth's surface. Perforated or slotted liners or expandable liners may also be used instead of a screen as a sand exclusion device. Hereafter, for the purposes of this application and the description of the invention, the term liner is used to refer to all such types of sand exclusion devices.

There are numerous prior art devices with different configurations of the liner and the components of the gravel pack and numerous methods for deployment of the devices. Examples of such devices are found in U.S. Pat. No. 5,829,522 to Ross et al., and U.S. Pat. No. 6,053,250 to Echols. Regardless of the device used and the method of deployment, the line and gravel pack must be designed to withstand the stresses in the subsurface formation: failure of the screen or a breakdown of the gravel pack can lead to sand production from the formation and plugging of the borehole. The selection and design of the liner depends on analysis of formation strength, strength distribution, permeability, permeability distribution, shale content, fines migration, and grain size and distribution. Of these factors, permeability, permeability distribution, grain size, and grain distribution can be measured with reasonable accuracy; however, most oil companies still have difficulty conducting formation strength and strength-distribution analyses. The two primary reasons for poor analysis are that mechanical logs available from service companies are not reliable or must be calibrated with other methods and that reasonably reliable numerical models for strength analysis are owned exclusively by several companies.

Another factor complicating the design of liners is that when fluid is produced from a reservoir, a reduction in pore pressure occurs. The pressure reduction is greater near the wellbore and increases with production time and rate. The reduction in pore pressure causes compaction of the formation containing the reservoir fluid, which imposes radial and axial loads on the well. Wellbore loads resulting from reservoir compaction are seldom considered in the design of casings, liners, and gravel-pack screens, yet they can be significant. Radial and axial pressures on wellbore tubulars from reservoir compaction are illustrated in FIG. 1 for a vertical well. For a deviated well, the wellbore is exposed to a radial component of the vertical overburden load, increasing external pressures on tubulars. Determining reservoir compaction loads on wellbore tubulars is not a simple task. Field measurement of reservoir compaction loads is difficult because of the time required for these loads to develop and the difficulty in measuring them. Simple analytic techniques for calculating reservoir compaction do not account for all the important variables affecting well loads. A computer model, however, can incorporate the many important variables to obtain realistic predictions of these loads.

Morita provides a comprehensive discussion of different sand-prediction models. As discussed therein, three types of field models are commonly used for predicting the onset of sand production. Core-based models are numerical models with a set of stress-strain curves as input to calculate the cavity stability and strength. Sonic based models are direct approximations from standard mechanical logs that calculate cavity stability using a linear stress/strain model. Regional statistical sand-production models involve back-calculation methods where a base solution incorporates a correction factor determined by field sand-production data.

Wooley & Prachner provide a methodology for the analysis of compaction loads on casings and liners of vertical and/or deviated boreholes resulting from reservoir depletion. The methodology uses a finite element simulation and is based on the separation of formation stress into a component of pore pressure and matrix stress. First, overall subsidence is computed with a large-scale model. The solution applies undisturbed boundary conditions far from the compacting reservoir and computes deformations and stresses near the well, in the reservoir, and in surrounding formations. Second, a near-well analysis is used to compute loads on the well. Effects of formations beyond the near-well region are transmitted to the solution by means of boundary displacements, which are defined from deformations computed with the large-scale model.

As discussed by Hamid et al., liner collapse occurs from application of differential pressures (across the screens) that exceed the collapse strength of the screen jacket. The resulting failure may not always be critical. In general, screen jacket collapse may lead to subsequent long term erosive failure.

Modeling of liner failure is typically carried out using a finite element analysis (FEA). Guinot et al. (U.S. Pat. No. 6,283,214) use a FEA to show that a particular shape and orientation of the perforations of a liner minimizes this destabilization, hence also minimizes sand production. In particular, and in the specific case of a vertical wellbore, for instance, elliptically shaped perforations, having the major axis aligned in the direction of maximum principal in situ, or compressive stress, improve the stability of the formation in the region near the wellbore, hence minimizing sand intrusion. Particularly preferred embodiments of this aspect of the Invention are perforations with an aspect ratio of about 5:1, and having their principal axis substantially aligned with the direction of maximum compressive stress.

Prior art methods of modeling the failure of liners predict the load on the liners using a combination of experimental data and FEA. The experimental data are used to define parameters of a model in which the parameters characterizing the liner and the formation are relatively uniform.

There may be a variation in the stresses applied to the liner but the material comprising the liner and the formation is relatively homogenous. Failure prediction in models like this is based on average properties of the formation surrounding the liner as well as the liner itself. In reality, such homogeneity rarely exists in the formation around the well and in the liners: on a local scale, there may be statistical variations in the strength including anisotropy effects. In practice, failure usually occurs at the weakest point resulting in asymmetric loading creating localized deformation that can cause early failure of the liner. Accounting for statistical distribution of properties and the development of local failure areas are impractical to consider using the commonly used finite element analysis techniques. There is a need for a method of analysis and prediction of failure of liners that takes into account statistical variations in the properties of the vicinity of the borehole and liner. Such an invention should also be computationally fast. In addition, it is preferable that the invention should be user friendly in that specification of the material properties and loading be easily input and that the invention be able to provide graphical displays of the deformation and fracture process. The present invention satisfies this need.

SUMMARY OF THE INVENTION

The present invention is computer implemented method of modeling failure of a borehole in a subsurface formation. A mode of definition of a subsurface model characterizing the borehole and its environs is selected that is one of (i) an aerial mode wherein the model comprises a plurality of nodes in a plane orthogonal to a longitudinal axis of the borehole, and (ii) a 3-D mode. A subsurface model is defined that includes the borehole and at least one additional region selected from (i) a liner in the borehole, (ii) a casing in the borehole, and (iii) at least one earth formation such as a near region and a far region. Each of said plurality of regions comprises a plurality of nodes interconnected by linkages that may be springs, rods or beams. Material properties associated with the regions are defined, the material properties having a statistical variation. An initial deformation pattern of the model is defined and using a dynamic range relaxation algorithm (DRRA) a force equilibrium solution for the model and the initial deformation pattern is determined that includes fracturing that simulates failure of the material surrounding the borehole. In an alternated embodiment of the invention, instead of an initial deformation pattern, stresses are applied on the boundaries of the model.

Stresses applied in the model may include stresses produced by reservoir depletion and an associated decrease in formation fluid pressure. This makes it possible to predict lining of casing failure in a producing reservoir.

In an alternate embodiment of the invention, large scale geologic simulation using a prior art DRRA method is used for determining stresses in subsurface formations. Using these stresses, it is possible to use the method of the present invention to predict possible failure of a wellbore during the process of drilling along a predetermined trajectory in the subsurface.

BRIEF DESCRIPTION OF THE DRAWINGS

The file of this patent contains at least one drawing executed in color: Copies of this patent with color drawing(s) will be provided by the Patent and Trademark Office upon request and payment of the necessary fee. For detailed understanding of the present invention, reference should be made to the following detailed description of the preferred embodiment, taken in conjunction with the accompanying drawings, in which like elements have been given like numerals and wherein.

DETAILED DESCRIPTION OF THE INVENTION

The present invention uses a Dynamic Range Relaxation Algorithm (DRRA) for the modeling of borehole failure. U.S. patent application Ser. Nos. 09/542,307 (the '307 application) filed on Apr. 4, 2000, now U.S. Pat. 6,370,491, and application Ser. No. 09/949,966 (the '966 application) filed on Sep. 10, 2001, now U.S. Pat.No. 7,043,410, disclose a method of using a DRRA for the modeling of deformation and fracturing of earth formations on a geologic scale. The present invention uses many of the concepts from the '307 and the '966 application.

Figure 2:
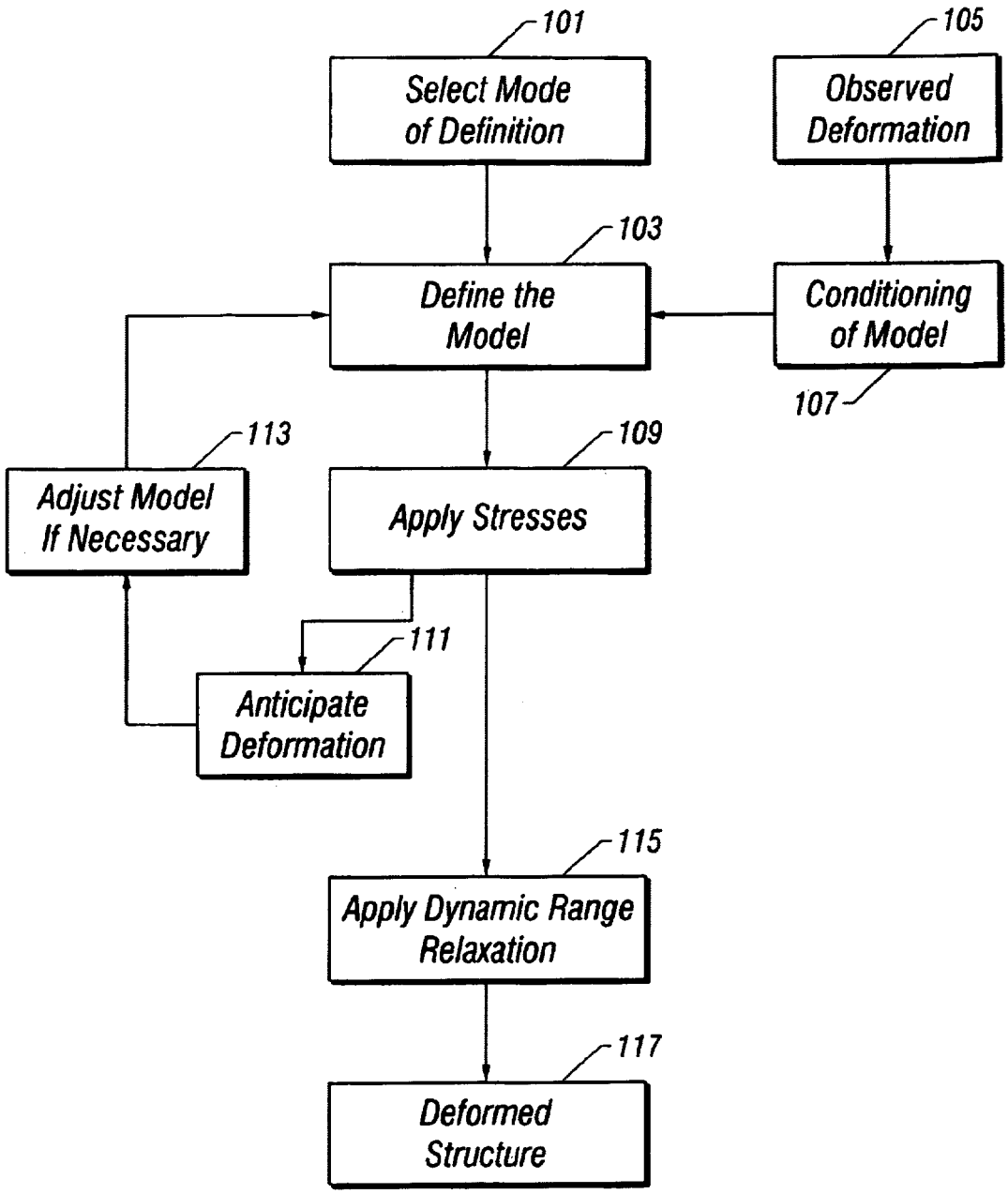
FIG. 2 is a flow chart illustrating the major steps of the use of a Dynamic Range Relaxation Algorithm for modeling of fractures.

Turning now to FIG. 2, a flow chart of the major steps of using a DRRA are shown. The first step in the invention isto select a mode of definition of the subsurface 101. This step defines the boundaries of the model and the nodal configuration therein. The mode of definition may be aerial, cross-sectional or 3-D. Within the model, a plurality of interconnected nodes that characterize the geometry of the model are defined. In a preferred embodiment of the invention, the nodal pattern is a regular triangular lattice, although other patterns, such as a random lattice, may also be used. The user may also specify the number of nodes in and the aspect ratio of the model.

Within the framework of the nodal geometry defined at 101, the material properties of model are input 103. The nodes are interconnected by bonds such as springs, beams, or rods having elastic properties and breaking strengths related to the physical model. In a preferred embodiment of the invention, the springs are linear elastic springs. In an alternate embodiment of the invention, any user-specified stress-strain curve may be used. The user may also specify independently a repulsion between the nodes. In the beam model, the force is based upon linear beam equations of standard elastic theory. In the rod model, there is an angular force determined by the angle between links between nodes. The purpose of these forces (spring, beam, or rod) is to stabilize the matrix involved in the solution of the deformation process. In a preferred embodiment of the present invention, the conditioning of the model 107 as described in the '307 and '966 applications is not used.

In one embodiment of the invention, the forces act between adjacent nodes (nearest neighbors). In an alternative embodiment of the invention, the forces act between additional nodes that are farther away, i.e., between next nearest neighbors or even further neighbors. Again, the addition of forces between next nearest neighbors is to stabilize the solution matrix. In a preferred embodiment of the invention, the next nearest neighbor forces are used in conjunction with the spring model, though the next nearest neighbor forces could also be used with the beam model or the rod model.

Once the model has been defined, the deformations are applied to the model 109. The result of deformation is to produce a deformed model with faulting and fracturing therein. This determination of the deformation process is carried out using a Dynamic Range Relaxation model 115 that is discussed in the '307 and '966 applications. The resulting deformed structure 117 from the model simulates the fracturing processes that occur in the real world and may be analyzed by those versed in the art to determine a likely mode of failure of the borehole.

The '307 and '966 applications also discuss use of the Anticipate 111 and model adjustment 113. These are intended for getting an approximate look at the results of the deformation and are primarily intended for the large complicated models encountered in geologic modeling. These steps are not used in a preferred embodiment of the present invention that is aimed at local modeling of borehole failure. They may, however, be used when simulating the full length of a borehole.

Another aspect of the '307 and '966 inventions is a conditioning process. The geologic interpretation process starts with the final position of the faults, and, in particular, the large-scale faults 105. These could be observations of surface faulting, as well as faults interpreted from the wellbore. In geologic modeling, it is essential that the deformed structure 117 include in it at least these large scale faults. Usually, the initial model is obtained from basic principles that would be familiar to a structural geologist. The observed fault structure is "undeformed" by reversing the process that produced the faulting in the first place. This is entirely a kinematic procedure that repositions the various fault blocks consistent with the laws of gravity and conservation of mass to the initial position they must have been in before the deformation started. This process is sometimes referred to as palinspastic reconstruction. Application of deformation to the FramView™ model used in the '307 and '966 applications. usually results in the observed large-scale deformation. However, in some cases this may not be enough. In such cases, the conditioning of the model is carried out. In the conditioning process, the model is weakened at the reconstructed fault positions so that after deformation of the model, fracturing and faulting are more likely at these positions. This too is not usually necessary for local borehole failure modeling.

The '377 and '966 applications also provide a discussion of the graphical user interface used in geologic modeling. With slight modifications, the graphical user interface may also be used in the present invention.

Figure 1:
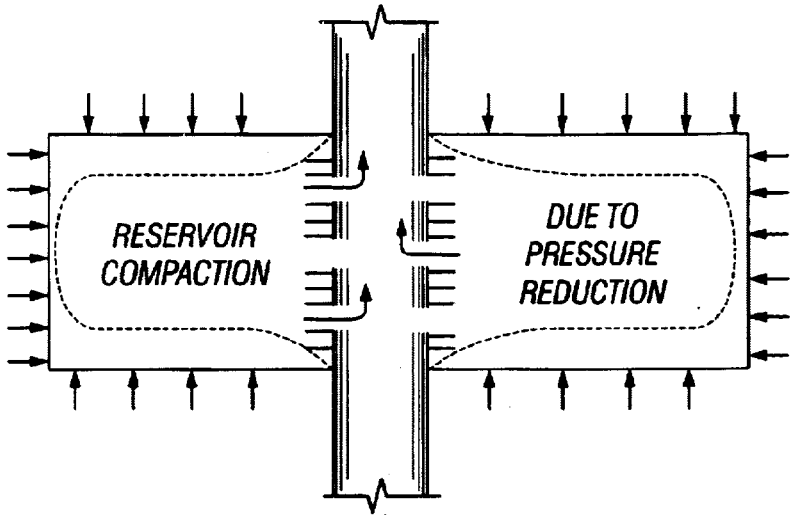
FIG. 1 (PRIOR ART)
FIG. 1 (Prior Art) illustrates the phenomenon of reservoir compaction due to pressure reduction.
Figure 3:
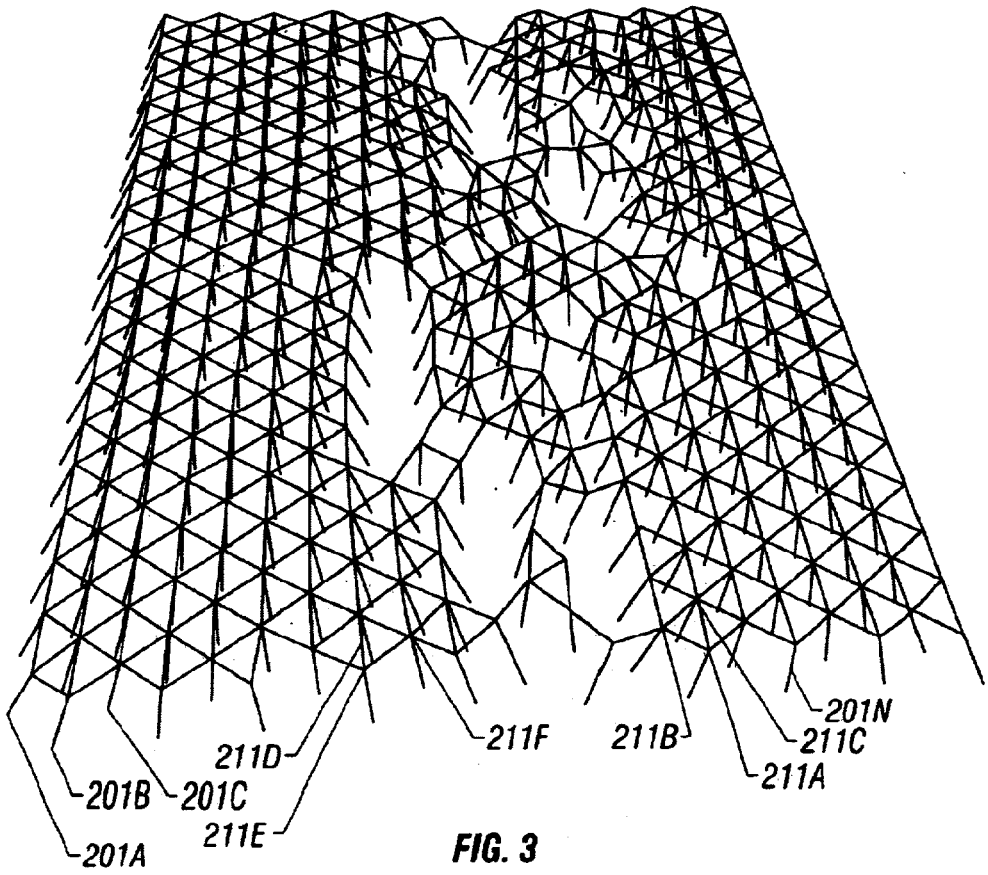
FIG. 3 (PRIOR ART)
FIG. 3 (Prior Art) show the triangular nodal configuration for an serial model.

Turning now to FIG. 3, an aerial model is depicted. In the picture above, two sets of nodes are shown. The lower plane is a set of nodes 201*a*, 201*b*, 201*c* . . . 201*n* called the "substrate". The upper plane consists of the nodes 211*a*, 211*b*, 211*c* . . . 211*f* that make up the material itself. In one embodiment of the invention, called the nearest neighbor model, a line is drawn connecting each of the nodes in the material with its neighboring nodes. These lines represent bonds such as springs, beams, rods or attractive forces between the nodes. In the example here two sets of springs are shown. One set is in the plane of the nodes; the other extends down to one of the nodes in the substrate. In a way, this picture is incorrect, because the actual model is really only two-dimensional. The entire model lies in a plane, so that the substrate nodes are not really below the material nodes, but instead lie in the same plane with the material nodes. In an alternative embodiment of the invention, forces are introduced not only between nearest neighbors but also between next nearest neighbors.

To deform the material, the substrate nodes are moved according to deformation arrows defined in the model interface. In the aerial mode, deformation arrows (not shown) can be applied at any point in the substrate. These are applied in a point and click manner. A suitable interpolation is done between the points at which the deformation is applied. As the substrate nodes are moved, the material nodes are "pulled along" and are separated from each other. As part of the model definition, a statistical distribution of breaking strengths is defined in the interface. In a spring model, the distribution of breaking strengths has an equivalent distribution of breaking lengths. Hereafter, the two terms may be used interchangeably. From this distribution of breaking lengths, a breaking distance has been assigned to each spring. If the length of any spring exceeds its breaking distance, that spring is broken and is never re-attached. The distribution of breaking lengths is assigned by giving a mean and the standard deviation of the breaking distances. A random number seed is used to choose one breaking length from the distribution for each spring on the spring network. As soon as the length of a spring connecting two nodes exceeds its breaking length, the spring breaks. By changing the random number seed, a number of realizations can be made from the same breaking distribution. These features cannot be implemented in the usual finite element analysis approach without the user recreating the finite element mesh as each fracture develops. This makes the finite element approach practically impossible when large numbers of fractures progressively develop.

In the 3-D mode, the nodes are preferably in a triangular configuration with an overall cylindrical geometry to simulate a borehole. The deformation may be applied to the sides of the volume of the material region.

The FramView™ simulation requires that at each time step the sum of forces on each node to be zero. The forces described in the '307 and '966 applications consisted of the spring forces (or beam or rod) and gravity. In the present invention, another force can be added to directly to each node. In one embodiment of the invention, this is the difference in fluid pressure between one side of the node and the other. This fluid force gradient can be calculated by solving, in addition to the discrete element simulation (FramView™), a finite difference (or finite element) simulation which tracks fluid flow. These flow simulations go by the name of "reservoir flow simulators" and are well known to those versed in the art. These flow simulators calculate the fluid pressure at any point in space in response to fluid production or injection at well bore locations. Knowing the fluid pressure at each point also means that the pressure gradient is known at each point. In an optional embodiment of the invention, this pressure gradient at each node location can be used to predict an additional fluid force on each node. With this modification, in addition to having the fluid simulator influence the node motions, the node motions in turn can be used to influence the fluid flow simulations. One of the input values in a fluid flow simulator is the permeability (or transmissibility) between each point modeled in the finite difference or finite element grid. The change of any node positions can be used to influence the local permeability in that region of space. For example, if a bond is broken due to node motions, permeability in the flow simulator can be increased to simulate increased ease of flow due to a fracture a that location. Similarly, bonds pushed tightly together can cause a decrease in permeability if there are no broken bonds. Lastly, if desired, the change in local density of nodes could also change the porosity in the flow simulations (which is also an input parameter needed for these simulations.) In prior art flow simulators, permeability and porosity are not varied in time, but are assumed constant. In an optional embodiment of the present invention, permeability and porosity are changed as nodes moved in the discrete element simulation. The invention described in the '307 and the '966 applications has been modified in the present invention so that instead of applying deformation to the substrate, stresses may be applied to the boundary nodes as described earlier in this paragraph. With the ability to add stresses directly to nodes, the FramView™ software has additional flexibility in the simulation of deformation processes. An example is given next.

In an optional embodiment of the invention, the initial geometry may be defined by using a FramView™ simulation of large scale geologic deformation such as described in the '306 and '977 application. A geologic-scale simulation is run to produce a deformation that now appears in the subsurface. For example, one side of a material region is extended until a graben is produced that looks like what is seen in a seismic image. This may be done in 2D or 3D. The "final" state of this FramView™ geologic simulation would have not only the positions of the nodes corresponding to material in the subsurface, it would also contain the forces or stresses between the nodes. In one application, a well trajectory is defined through the material region which would correspond to a planned well track. The stresses from the geologic simulation are then included in the present invention as preexisting stresses and used to identify points along the well track that are likely to result in failure. In an alternate embodiment of the invention, nodes along the well track are removed to simulate the drilling of the well. Removing these nodes would cause the remaining nodes to move in response to the changing stress which would occur because nodes are now "gone". If the nodes surrounding the wellbore tended to move into the space occupied by the missing nodes, this would indicate that in these regions the well is more likely to fail at these locations rather than other locations along the well track. This simulation of wellbore failure does not require the presence of a casing or liner in the borehole and the model may just comprise the borehole and the formation.

Figure 4:
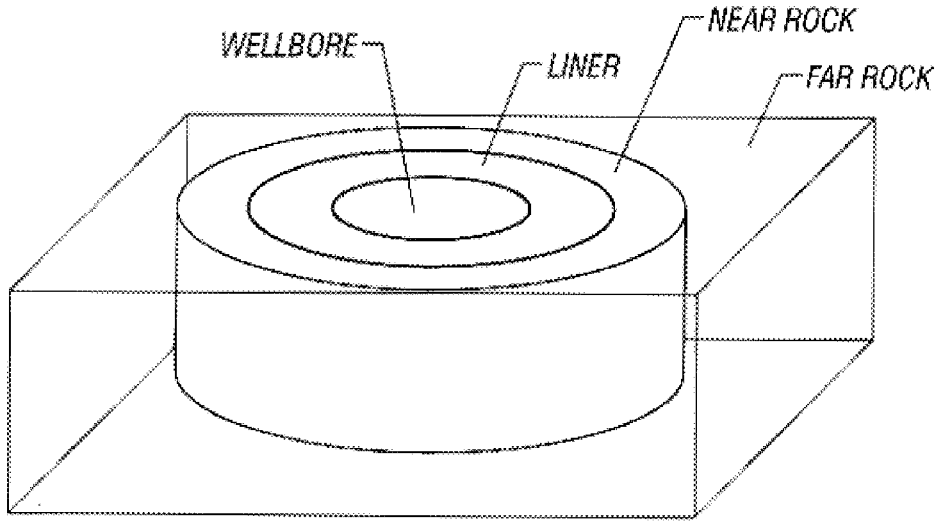
FIG. 4 illustrates the geometry of an illustrative model with four zones.

Turning now to FIG. 4, an exemplary model of the vicinity of a borehole is shown. Four regions are indicated by the wellbore 301, a liner 303, the near rock earth formation 305 and the far rock earth formation 307. The four regions are for illustrative purposes only and the method of the present invention may be used for other situations, e.g., an open borehole or a cased borehole. The near rock earth formation 305 may include a gravel pack.

Figure 5:
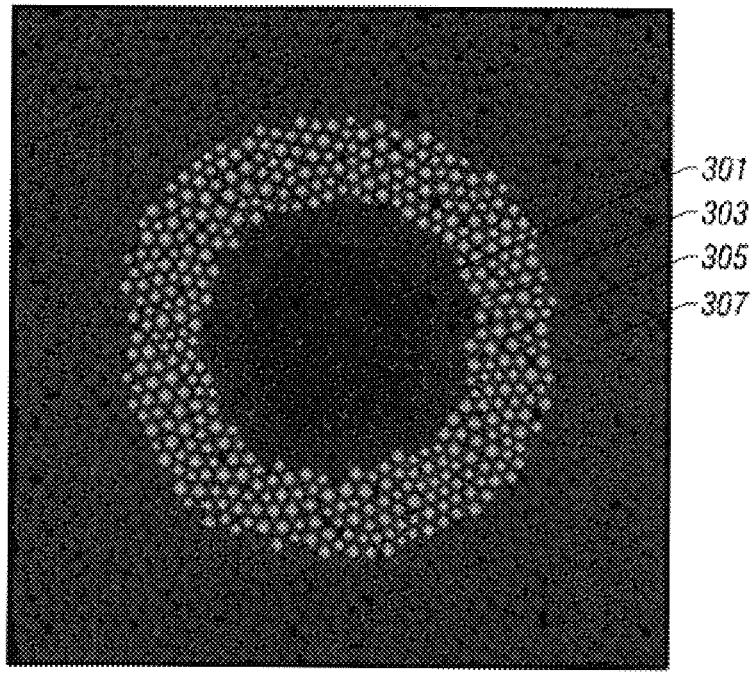
FIG. 5 shows the nodes for the model of FIG. 4.
Figure 6:
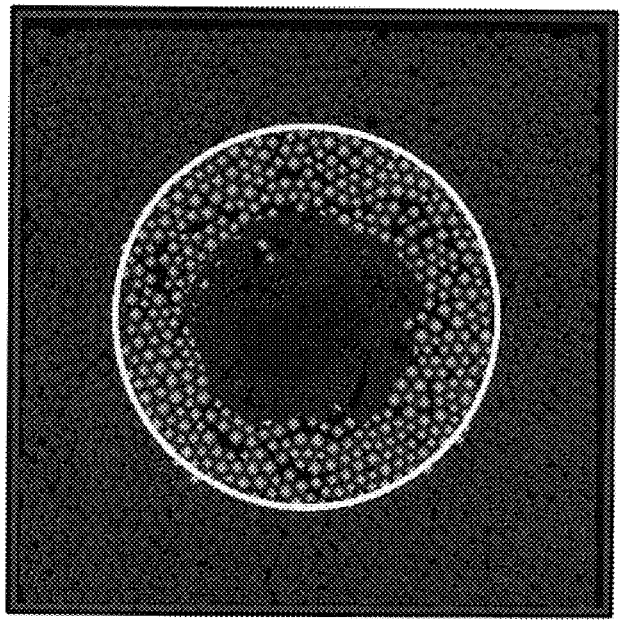
FIG. 6 shows the nodal configuration of the model of FIG. 4 after application of stress leading to failure of the borehole.
Figure 7:
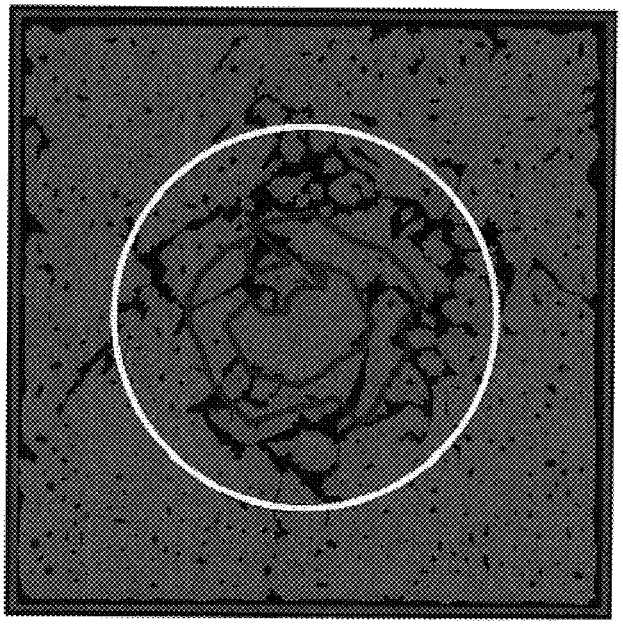
FIG. 7 is a post-failure view of the model emphasizing the fracturing in the model.

Referring now to FIG. 5, the nodal configuration for the model of FIG. 4 is shown. A different color is used for each of the four regions. After application of the boundary loads and/or displacements the result is the nodal configuration shown in FIG. 6. An alternate image that may be obtained is the one shown in FIG. 7 wherein the bonds that have been fractured during the deformation process are shown in black. The failure of the borehole is easier to interpret than in the illustration of FIG. 6.

Figure 8A:
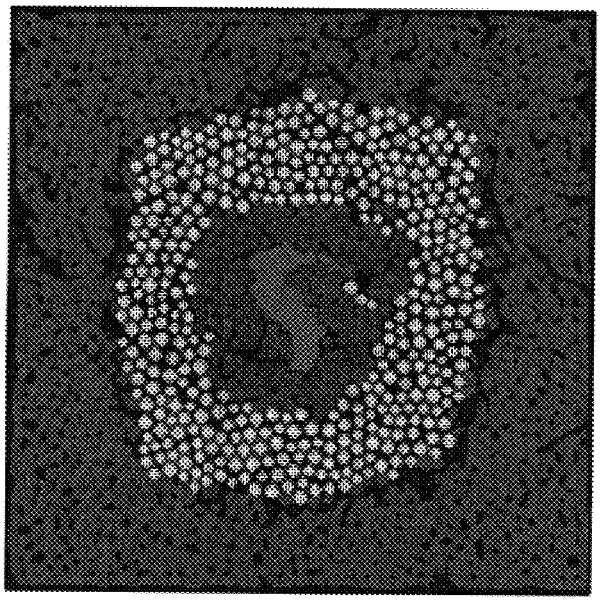
FIG. 8 shows post failure views of the model for two different values of the near rock compressibility.
Figure 8B:
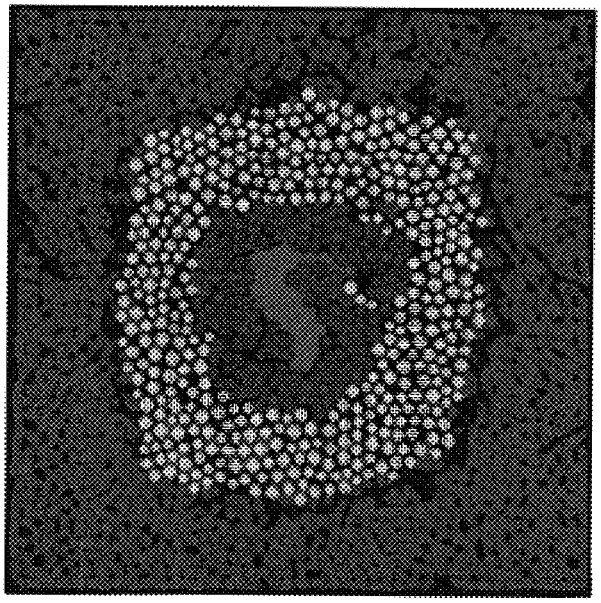

Another capability of the present invention is demonstrated in FIG. 8. The illustration on the right corresponds to a fracture simulation wherein the near rock compressibility is 1.2 times the compressibility of the far rock whereas the figure on the right corresponds to a situation in which the near rock compressibility is 0.8 times the compressibility of the far rock.

Those versed in the art would recognize that in a vertical well, the stresses and deformation are generally azimuthally symmetric whereas in a deviated well, the stresses and deformation will be azimuthally asymmetric due to the radial component of the overburden stresses. In the present invention, this possible azimuthal asymmetry is taken into consideration.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A computer implemented method which models failure of a borehole in a subsurface formation, the method comprising:

(a) defining a subsurface model in the computer, the model including a plurality of regions, said plurality of regions including the borehole and at least one additional region selected from (i) a liner in the borehole, (ii) a casing in the borehole, and (iii) at least one earth formation, each of said plurality of regions comprising a plurality of nodes interconnected by a plurality of linkages, (b) defining material properties associated with said nodes and said linkages of said subsurface model, said material properties having a statistical variation;

(c) specifying an initial deformation pattern of the model; and (d) using a dynamic range relaxation algorithm (DRRA) implemented on the computer to find a force equilibrium solution for said subsurface model and said initial deformation pattern giving a resulting deformed model including fracturing.

2. The method of claim 1, wherein said nodes are arranged in a grid that is one of (i) a triangular grid, and, (ii) a random grid.

3. The method of claim 1 wherein said linkages are selected from the group consisting of (A) springs, (B) beams, and (C) rods.

4. The method of claim 1 wherein said linkages comprise springs, the method further comprising defining a normal force associated with each spring.

5. The method of claim 1 wherein said linkages comprise beams, the method further comprising defining at least one of (A) a normal force, and (B) a shear force associated with each beam.

6. The method of claim 1 wherein said linkages comprise rods, the method further comprising defining at least one of (A) a normal force and (B) a force associated with an angle between pairs of said adjacent ones of the plurality of rods.

7. The method of claim 1, wherein wing the dynamic range relaxation algorithm further comprises applying said initial deformation model in a plurality of steps, each step comprising applying a specified fraction of the initial deformation and determining if any linkages between the nodes have been deformed beyond a breaking point and identifying a subset of the linkages that have been so deformed.

8. The method of claim 7, wherein applying the dynamic range relaxation algorithm further comprises iteratively breaking the one linkage of the subset of linkages that has been deformed the most and applying a relaxation algorithm to the remaining unbroken linkages.

9. The method of claim 1 wherein the at least one earth formation further comprise a near earth formation including a gravel pack and a far earth formation.

10. The method of claim 1 wherein the plurality of regions comprises a liner in the borehole, an earth formation including a near earth formation and a far earth formation, and a gravel pack disposed between the liner and the near earth formation.

11. The method of claim 1 wherein said linkages connect at least one selected node of said plurality of nodes with (i) a plurality of nearest neighbors of the at least one selected node, and (ii) a plurality of next nearest neighbors of the at least one selected node.

12. The method of claim 1 wherein said earth formations include a fluid, said fluid flowing into the borehole, and said deformation pattern is determined in part by a decrease in formation fluid pressure resulting from flow of said fluid into the borehole.

13. The method of claim 12 wherein using the DRRA further comprises determining an additional force at each node related to a difference in said fluid pressure on opposite sides of at least a subset of the plurality of nodes.

14. The method of claim 13 wherein determining said additional force further comprises performing a simulation selected from (i) a finite difference simulation, and, (ii) a finite element simulation, of said fluid flow.

15. The method of claim 14 wherein performing said simulation further comprises changing at least one of (A) a permeability, and, (B) a porosity used in said simulation responsive to said deformation.

16. The method of claim 1 wherein said borehole includes a substantially vertical section wherein said initial deformation pattern is substantially azimuthally symmetric about an axis of the borehole in said section.

17. The method of claim 16 wherein said borehole includes a deviated section wherein said initial deformation pattern is asymmetrical about an axis of the borehole.

18. A computer implemented method which models failure of a borehole in a subsurface formation, the method comprising:

(a) defining a subsurface model in the computer, the model having a plurality of nodes and including a plurality of regions, said plurality of regions including the borehole and at least one additional region selected from (i) a liner in the borehole, (ii) a casing in the borehole, and (iii) at least one earth formation, each of said plurality of regions comprising a plurality of nodes interconnected by a plurality of linkages, (b) defining material properties associated with said nodes and said linkages of said subsurface model, said material properties having a statistical variation;

(c) specifying a force distribution applied to the model at boundary nodes of said plurality of nodes; and (d) using a dynamic range relaxation algorithm (DRRA) implemented on the computer to find a force equilibrium solution for said subsurface model and said force distribution giving a resulting deformed model including fracturing.

19. The method of claim 18 wherein the subsurface formation has been subjected to large scale geologic deformation and wherein specifying said force distribution further comprises:

(i) simulating the large scale geologic deformation to determine a stress distribution in the subsurface formation in the absence of the borehole, (ii) defining a trajectory for the borehole therein, and (iii) identifying locations along said trajectory that are likely to fall.

20. The method of claim 18 wherein the forces can vary between the boundary nodes.

21. The method of claim 19 wherein identifying said trajectories further comprises removing a plurality of nodes along said trajectory.

22. The method of claim 18, wherein said nodes are arranged in a grid that is one of (i) a triangular grid, and, (ii) a random grid.

23. The method of claim 18 wherein said linkages are selected from the group consisting of (A) springs, (B) beams, and (C) rods.

24. The method of claim 18 wherein said linkages comprise springs, the method further comprising defining a normal force associated with each spring.

25. The method of claim 18 wherein said linkages comprise beams, the method further comprising defining at least one of (A) a normal force, and (B) a shear force associated with each beam.

26. The method of claim 18 wherein said linkages comprise rods, the method further comprising defining at least one of (A) a normal force and (B) a force associated with an angle between pairs of said adjacent ones of the plurality of rods.

27. The method of claim 18, wherein using the dynamic range relaxation algorithm further comprises applying said force distribution in a plurality of steps, each step comprising applying a specified fraction of the initial force and determining if any linkages between the nodes have been deformed beyond a breaking point and identifying a subset of the linkages that have been so deformed.

28. The method of claim 27, wherein applying the dynamic range relaxation algorithm further comprises iteratively breaking the one linkage of the subset of linkages that has been deformed the most and applying a relaxation algorithm to the remaining unbroken linkages.

29. A computer implemented method which models faulting and fracturing in a subsurface volume of the earth comprising:

(a) defining a subsurface model in the computer, the model including a plurality of interconnected nodes and material rock properties within the subsurface volume;

(b) specifying a stress distribution at a subset of said plurality of nodes, said subset comprising boundary nodes; and (c) using a dynamic range relaxation algorithm implemented on the computer to find a force equilibrium solution for said subsurface model and said stress distribution giving a resulting deformed model including fracturing.

30. The method of claim 29, wherein defining a subsurface model, and specifying said stress distribution further comprises using a graphical user interface.

31. The method of claim 29, wherein said nodes are arranged in a grid that is one of (i) a triangular grid, and, (ii) a random grid.

32. The method of claim 29, wherein said nodes are interconnected by linkages selected from (i) springs, (ii) beams, and, (iii) rods.

* * * * *

UNITED STATES PATENT AND TRADEMARK OFFICE

CERTIFICATE OF CORRECTION

PATENT NO. : 7,188,058 B2
APPLICATION NO. : 10/036813
DATED : March 6, 2007
INVENTOR(S) : Humphrey H. Hardy and Mamdouh M. Salama It is certified that error appears in the above-identified patent and that said Letters Patent is hereby corrected as shown below:

Column 4, line 36, please delete “isto” and insert --is to--

Signed and Sealed this

First Day of May, 2007

JON W. DUDAS
*Director of the United States Patent and Trademark Office*